US008052067B2

(12) United States Patent
Andre

(10) Patent No.: US 8,052,067 B2
(45) Date of Patent: Nov. 8, 2011

(54) SELF-CLEANING ASSEMBLY EMPLOYING A GAP FILLER FOR A GUIDANCE OR RUNWAY RAIL ON THE GROUND

(75) Inventor: Jean-Luc Andre, Molsheim (FR)

(73) Assignee: Lohr Industrie, Hangenbieten (FR)

( * ) Notice: Subject to any disclaimer, the term of this patent is extended or adjusted under 35 U.S.C. 154(b) by 195 days.

(21) Appl. No.: 12/307,803

(22) PCT Filed: Jun. 22, 2007

(86) PCT No.: PCT/FR2007/001043

§ 371 (c)(1),
(2), (4) Date: Jan. 27, 2009

(87) PCT Pub. No.: WO2008/003843

PCT Pub. Date: Jan. 10, 2008

(65) Prior Publication Data

US 2009/0206169 A1 Aug. 20, 2009

(30) Foreign Application Priority Data

Jul. 7, 2006 (FR) ..... 06 06199

(51) Int. Cl.
*E01B 5/00* (2006.01)

(52) U.S. Cl. ..... 238/129

(58) Field of Classification Search ..... 104/48, 104/244; 238/2–5, 8, 127–129, 151–153
See application file for complete search history.

(56) References Cited

U.S. PATENT DOCUMENTS

| | | | | |
|---|---|---|---|---|
| 4,203,547 | A * | 5/1980 | van der Harst | 238/8 |
| 5,622,312 | A * | 4/1997 | Martin | 238/2 |
| 6,253,685 | B1 | 7/2001 | Lohr | |
| 6,364,215 | B1 | 4/2002 | Andre et al. | |
| 7,484,669 | B2 * | 2/2009 | Gray, Jr. | 238/3 |
| 2003/0168519 | A1 * | 9/2003 | Hofstetter, Sr. | 238/8 |
| 2005/0172851 | A1 * | 8/2005 | Andre et al. | 104/244 |

FOREIGN PATENT DOCUMENTS

| | | | |
|---|---|---|---|
| FR | 2 865 744 | A1 | 8/2005 |
| WO | 98/27281 | A1 | 6/1998 |
| WO | 00/06826 | A1 | 2/2000 |
| WO | 2005/085038 | A1 | 9/2005 |

* cited by examiner

*Primary Examiner* — Joe Morano, IV
*Assistant Examiner* — R. J. McCarry, Jr.
(74) *Attorney, Agent, or Firm* — Davis & Bujold, P.L.L.C.

(57) ABSTRACT

A self-cleaning assembly employing a gap filler for a rail on the ground which guides or in which there runs rollers or wheels with lugs housed in a groove so as to lie flush with or protrude only slightly from the ground and which has a gap on the side of the rail corresponding to the passage of the lug. A filling substance is placed in the gap outside of the dynamic footprint of the lug and at least partially lines the gap, at least partially filling it. The filling material has properties of compressibility and is positioned in such a way that under all normal conditions of use or normal environmental conditions, the gap remains filled outside of the dynamic footprint of the lug.

29 Claims, 6 Drawing Sheets

SELF-CLEANING ASSEMBLY EMPLOYING A GAP FILLER FOR A GUIDANCE OR RUNWAY RAIL ON THE GROUND

National stage of PCT/FR2007/001043 filed Jan. 22, 2007 which claims priority from French Application 0606199 filed Jul. 7, 2006

FIELD OF INVENTION

The invention relates to a gap lining for a rail used for guiding or rolling a railway or urban public transport vehicle by means of at least one flanged roller or railway wheel.

The top surface of the rail is generally flush with the ground or slightly above ground level.

In a particular application the invention concerns a gap lining for a guide-rail embedded in the ground with edges that form rolling tracks for an assembly that guides a vehicle on tires by means of one inclined roller or a pair of the same.

Classically, for guiding or rolling by or with one or more flanged roller(s) there must be a free space between the flange, the adjacent edge of the recess holding the rail and the rail fixture. This space is known as the "gap", and the said gap or gaps form(s) one or two channel(s) on either side all along the rail.

BACKGROUND OF THE INVENTION

Owing to its exposure to bad weather and to the environment, it often happens that the gap is locally blocked by an accumulation of plant matter, ice, snow, pebbles or other foreign bodies or objects that can obstruct the flange(s) during the passage of the guide roller(s) or railway wheels. Such obstacles can lead to severe problems, such as damage to the rollers or wheels or, more seriously, to their derailment.

To avoid such problems, the gap all along the guide-rail or rolling rail network must be cleared regularly. However, such cleaning is time-consuming and expensive, and cannot be carried out during operation of the transport network and in particular that part of it using the rail concerned. Besides, even regular cleaning does not ensure the total cleanliness of gaps constantly exposed to bad weather, discarded garbage and attempted vandalism.

The forward protection element known as a "pebble guard" enables hard objects and ones above a certain size to be cleared from a rail and more generally a guiding or rolling track. Such protection, however, is quite useless against debris and small objects that may be present in one or other of the channels along the rail, which potentially endanger the guiding function and the vehicle's rollers or wheels.

There is thus a need for a gap that enables such objects to be passed over in total safety.

SUMMARY OF THE INVENTION

The purpose of the present invention is to provide a lining for the gap alongside a guide-rail or rolling rail positioned substantially flush with the ground.

According to the invention the gap is lined with a specific material that ensures the free passage of wheel or roller flanges, and confers upon it a self-cleaning nature realized during the passage of flanged wheels or rollers.

The urban integration of ground-level guiding means by rails flush with the surface has specific advantages and, thanks to the invention, ensures the reliability and safety of guiding and rolling even in the locations most exposed to all kinds of debris and to bad weather.

The gap lining material has compressibility properties that enable it to ensure the cleaning of objects during or after the passage of the roller(s) or wheel(s), or their obliteration or pressing down into the material during the passage.

The invention relates to every manner of obtaining the basic nature and properties of the lining material, namely its compressibility.

The technical form of the gap lining is such that it does not interfere with the dynamic engagement of the rollers. The lining material is chosen such that it never interferes with that engagement, regardless of the environmental conditions, in particular the climate conditions and the conditions in which the vehicle is used within the limits specified by the manufacturer. In particular, the filler does not swell and expands very little or not at all regardless of the conditions of its environment or use, especially under the action of temperature variations or precipitations.

Advantageously, in suitable cases the material can be designed to insulate the rail electrically from the ground.

In certain preferable embodiments of the invention the lining material can have one or more of the following properties: it can be electrically insulating, with low thermal expansion, impermeable, elastic, and/or it may not retain water internally.

When the rail not only provides a guiding function but also supports the vehicle while it is rolling, it can be imagined that the gap lining does not hold the rail in place, this being done in some other way.

In contrast, when the rail only acts to guide the vehicle, it is easy to envisage fixing the rail by means of the lining material itself while filling the gap. For example, the bottom of the recess designed to hold the rail can be covered with the lining material, the rail can then be placed on the bed so constituted while also positioning the rail with precision in the recess, and the gap or gaps bordering the length of the rail as well as any other free, unused, volume of the recess can then be topped up with the lining material.

BRIEF DESCRIPTION OF THE DRAWINGS

Other characteristics and advantages of the invention will emerge on reading the detailed description given below, which relates to the attached drawings showing.

DETAILED DESCRIPTION OF THE INVENTION

The gap lining for a guide-rail or rolling rail according to the present invention will now be described in detail with reference to FIGS. 1 to 12. Equivalent elements in the various figures will be given the same index numbers.

The gap lining is applied to guide-rails for flanged rollers arranged vertically or inclined, but also for railway wheels, i.e. wheels with a flange that roll on a rail in the vertical or inclined position, whether alone or in pairs.

Figure 1:
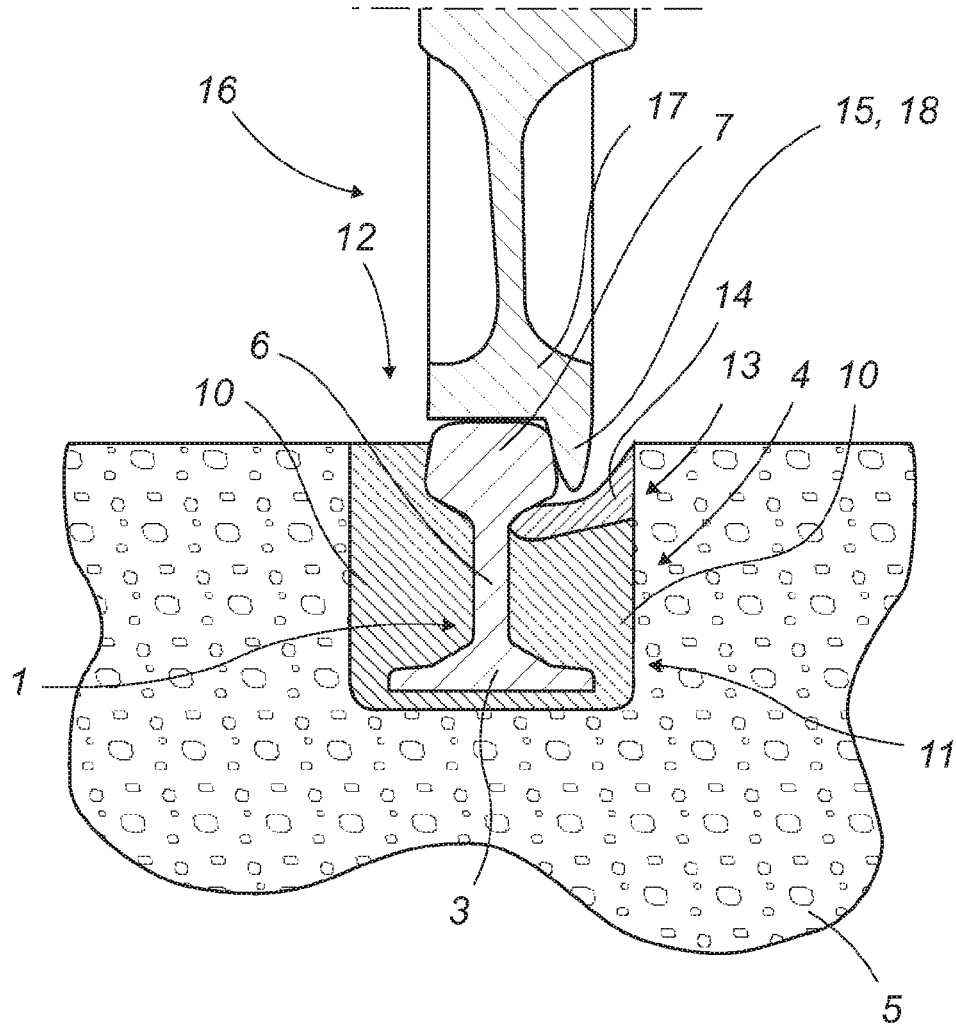
FIG. 1: Cross-section illustrating the application of the invention to a railway rolling rail.
Figure 2:
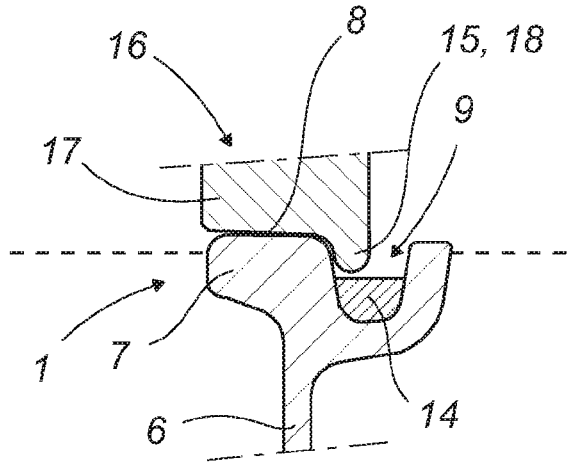
FIG. 2: Cross-section illustrating the application of the invention to a grooved railway rail.

FIGS. 1 and 2 aim to illustrate the general nature of the application of the present invention, by showing the case of a railway rolling rail with a classical profile and then one with a grooved profile.

As shown, the invention relates as much to a ground rail 1 for the rolling of a railway vehicle as to a ground-level guide-rail 2.

The rails 1 and 2 to which the invention relates are ones of the type comprising in particular a supporting base or foot 3 positioned below ground level and of the type that is mounted or held in a recess 4 formed in a solid base 5.

Classically, such rails have a web 6 which may be longer or shorter, and a rail head 7, technically of suitable shape with an upper, rolling surface 8 and a foot such as the supporting base 3, which is more or less wide and, if needs be, has a groove 9 (FIG. 2).

Preferably, the rails used in the invention are those of the type whose top is almost flush with the ground.

In general the base 3 of the rolling rail 1 shown as an example in FIG. 1 is surrounded by a filler material 10 that forms a filling 11 which delimits at the top at least one gap 12 which is covered or filled with a lining 13 of a compressible lining material 14 that can obliterate objects due to the compression of the material and/or expel them due to its elasticity and/or retain them embedded or encrusted during the passage of the roller(s) or wheels with flanges 15 at a level low enough for them not to impede the guiding, nor damage the rollers or wheels, especially avoiding any risk of derailment.

The same applies to a rolling rail 2 or guide-rail with a groove 9 (FIG. 2). In that case it is the groove 9 of the rail which acts as the gap 12. According to the invention, in such cases the bottom of the rail groove is lined with a suitable material such as the material 14, while leaving above the lining a space large enough to ensure that the material never interferes with the dynamic engagement of the roller(s) or wheel(s), regardless of the environmental conditions or the vehicle's conditions of use within the limits specified by its manufacturer.

Wheels such as that indexed 16 on the same side of a railway vehicle roll on such a rail. These are classical railway wheels with a rolling crown 17 and a flange 18, which roll on the upper, rolling surface 8.

As will be seen below, there is a real effect of pressing down debris and obstructive objects present on the upper surface of the lining or filling, with clearance during and after the passage of the railway wheel.

Particularly in the case of rollers or wheels with flanges 15 that only have a guiding function, the lining material 14 for the gap 12 can just as well be the filler material 10. It must at least be compressible, and therefore able to be compressed under the pressure of the object forced against it by the passage of the flange 15, so avoiding a vertical deflection of the guide roller or railway wheel that could result in derailment. The material 14 must never interfere with the engagement of the flanged rollers or wheels in any environmental conditions or conditions of use specified by the manufacturer, and it is desirable for the material to have low thermal expansion, to be resistant to aggression by its environment, and not to retain water coming for example from precipitation so that, in the event of freezing, there will be no swelling of the lining material 14 that could interfere with the dynamic engagement of the flanges.

This at least compressible material may also have the properties of elasticity and of electrical and/or noise insulation. For example, it may be a polymer material with high physical resistance to being torn and pulled out, and lasting resistance to temperature, light and in particular ultraviolet, and environmental aggression in general.

As examples of possible suitable materials the following can be mentioned: plastic cellular materials and in particular closed-cell foams such as a polyurethane foam, polymers, elastomers, plastomers, polymer resins, composite materials, and materials containing mineral or organic fillers.

Preferably, the lining material 14 for the gap 12 is made as a closed-cell foam or a polymer resin. It can also be made of a composite material or of gum or rubber derivatives or equivalents.

Figure 3:
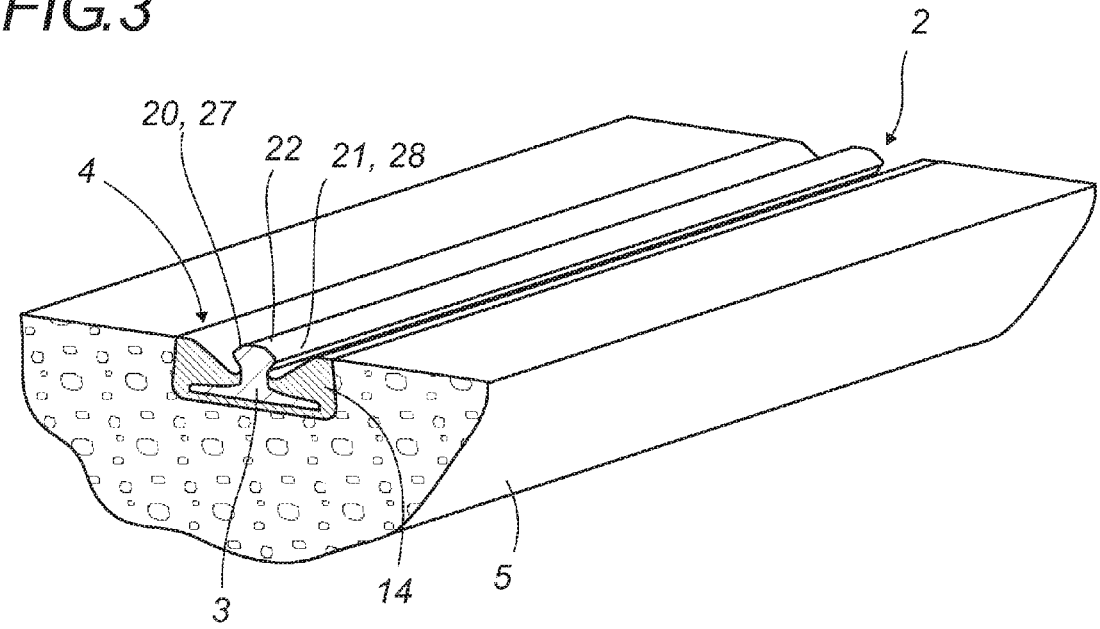
FIG. 3: Perspective view from above, of a first, flush-fitted ground-level guiding rail system with a gap lining according to the invention.

As a particular but non-limiting example, the description will now be given of an assembly as illustrated in perspective in FIGS. 3 and 4, which holds in position a guide-rail 2 thanks to filling of the channel or recess 4 formed in the solid base 5.

The guide-rail 2 can have several different profiles without going beyond the scope of the invention.

Figure 4:
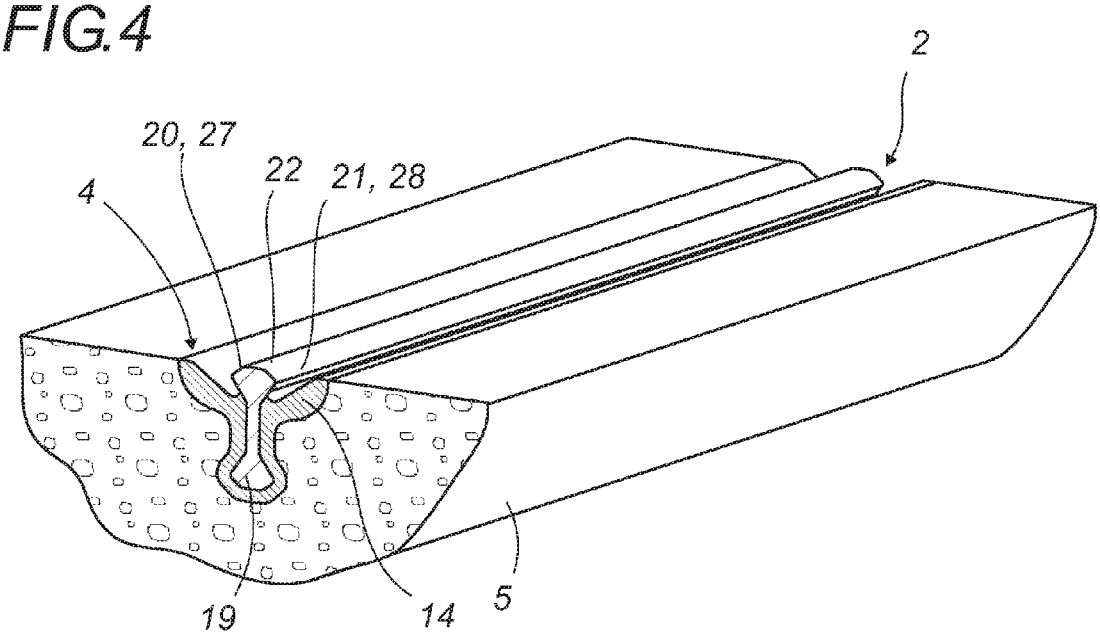
FIG. 4: Perspective view from above, of a second, flush-fitted ground-level guiding rail system with a gap lining according to the invention.
Figure 5:
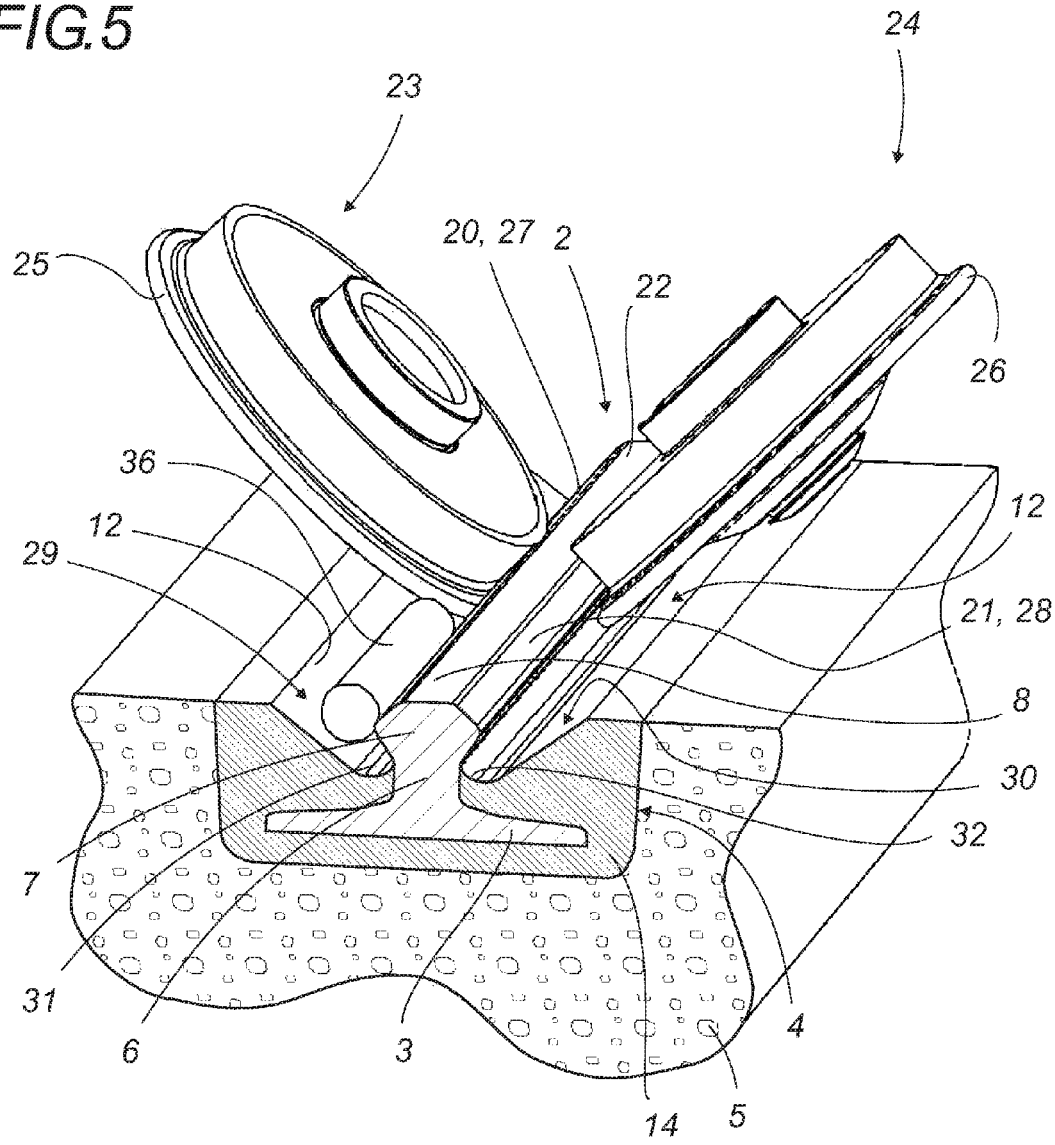
FIG. 5: Perspective view from above of a gap lining according to the invention, whose gap is obstructed by a solid object.
Figure 6:
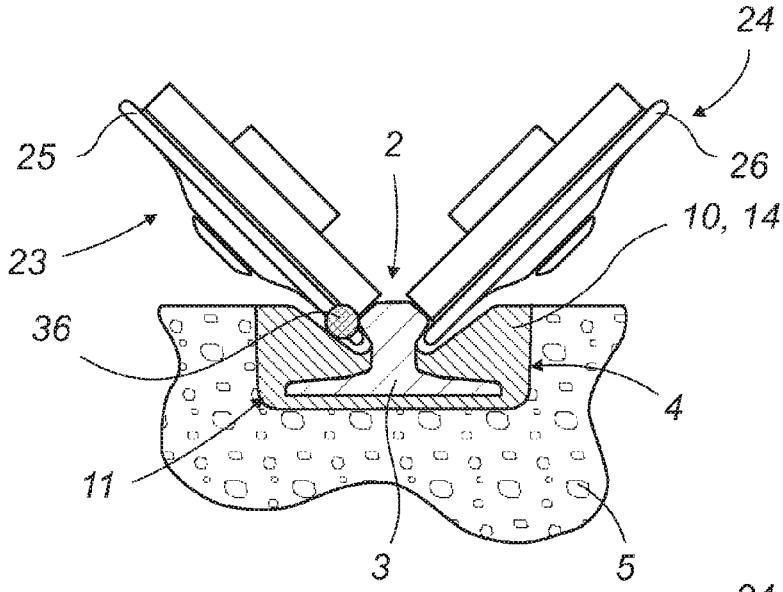
FIGS. 6 to 8: Sectional views illustrating the function of freeing the passage carried out by the gap lining according to the invention, in the case when a solid object is obstructing a gap such as that of FIG. 3.
Figure 7:
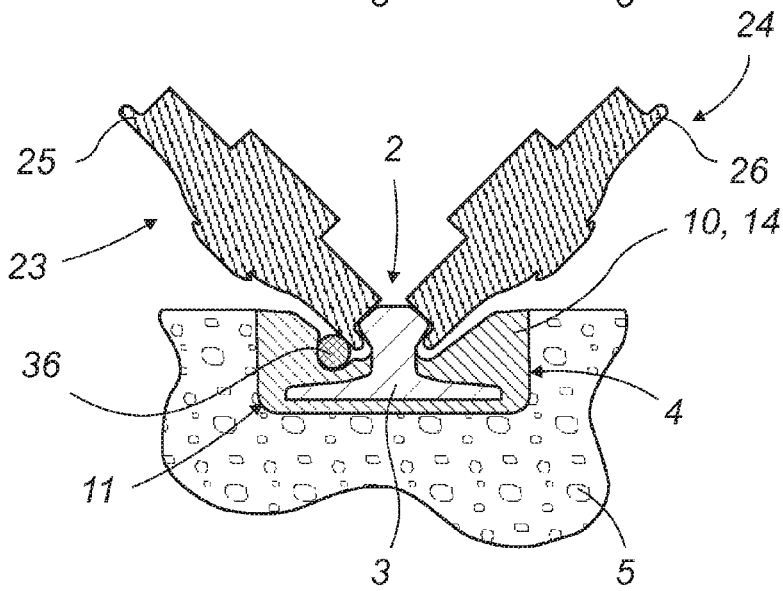

FIGS. 4 and 5 show two examples of profiles, one with a supporting foot 3 identical in shape to that of FIG. 1 and the other with a substantially I-shaped profile 19. The two rails illustrated have two rolling tracks 20 and 21 which are symmetrically inclined and are separated by a central upper surface 22 on which inclined guide rollers 23 and 24 with respective flanges 25 and 26 are rolling.

Of course, in this application the invention is not limited to just one type of guide-rail but concerns more specifically the partial or complete filling of the recess 4 with a single material having suitable properties or with two materials, one a filling and the other a lining material, the latter of which has the main property of compressibility required.

Nor is the invention limited to a particular guiding assembly with two inclined rollers, but on the contrary, relates to all types of guiding by means of a flush-mounted ground-level guide-rail.

The lining 13 of the gap 12 with its lining material 14 can if necessary be used to hold the guide-rail 2 in the ground, although this is not obligatory. In the case shown, namely that of rails which are not heavily loaded, i.e. rails whose function is only to guide, the lining surrounds the bottom and middle part of the rail and occupies the recess 4 made in the solid base 5 in such manner that, in a preferred embodiment, the only flush portion is the top of the guide-rail 2 and in particular the inclined lateral surfaces 27 and 28 on which the guide rollers 23 and 24 roll, which serve as rolling tracks for the latter.

At the top, the volume of the mass of material occupying the recess 4 has a V-shape with its point directed downward, opening in the middle onto the projecting part of the guide-rail 2 and delimiting along the rail two descending inclined ramps 29 and 30 each of which ends laterally close to the web of the rail, in each case with a groove 31 and 32 that serves as a gutter for the collection and run-off of liquids and fine debris. The V-shape of the upper part of the lining 13 of the gap 12 makes it possible to avoid any interference with the dynamic engagement of the guide rollers 23 and 24.

Advantageously, if the gap lining 13 according to the invention becomes degraded local repairs can be carried out by casting in a material that polymerizes at ambient temperature. Thus, a deteriorated gap lining 13 can be repaired without having to replace it entirely.

Advantageously, the lining 13 can be produced industrially by casting, extrusion or co-extrusion, or it can be cast in on the spot, or produced by any other suitable industrial process.

It can then be bent to adapt to the contour desired for the rail network and force-fitted into the recess 4 in the solid base 5 which, itself occupies the trench in the road.

Figure 12:
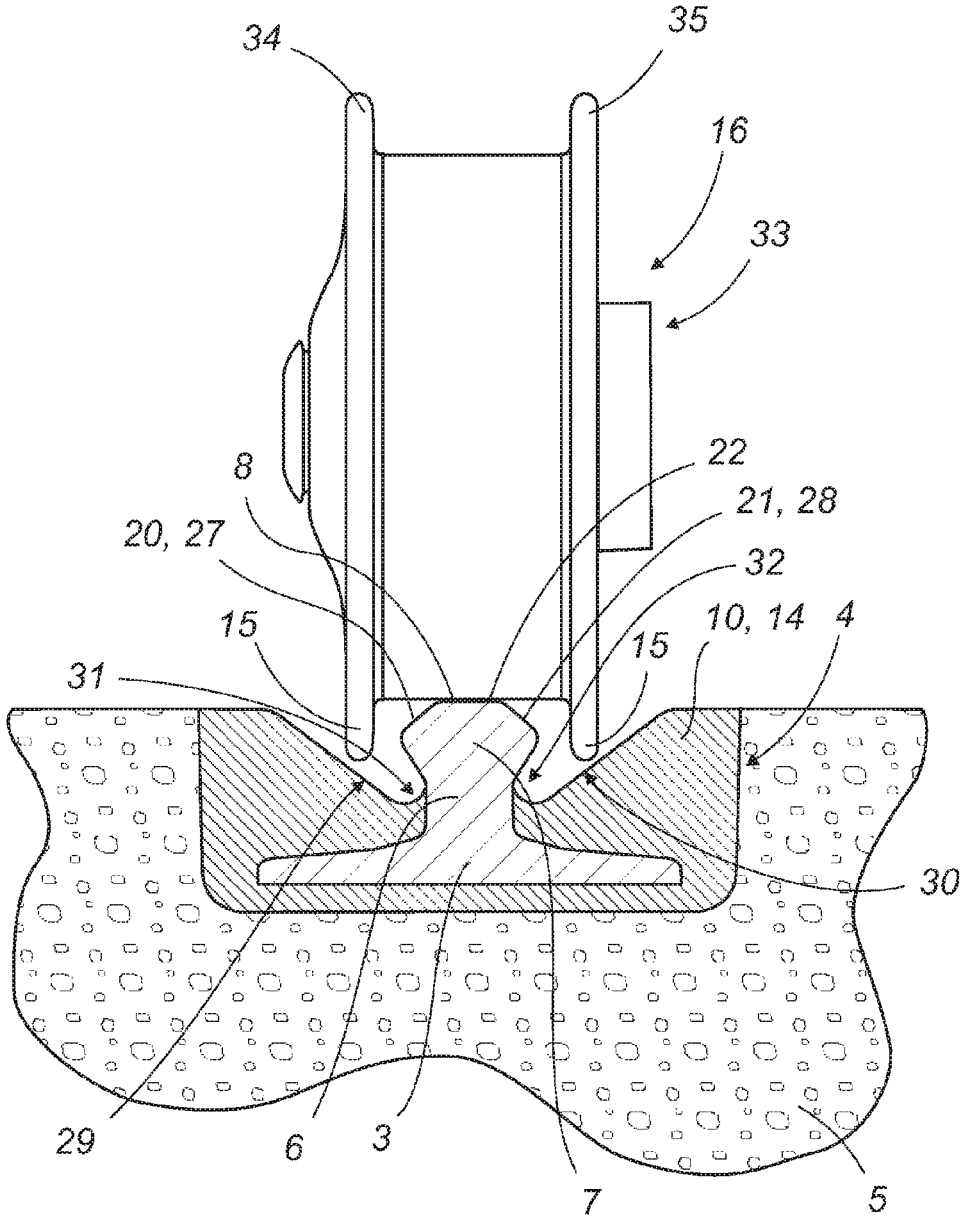
FIG. 12: Cross-section showing a guiding application for a vertical roller.

The gap lining 13 according to the present invention can also be used with rollers 33 having two flanges 34 and 35, as illustrated in FIG. 12. In this case the rail has a gap 12 on each side and each gap is filled with the lining material 14 as described above.

A description will now be given of the function of clearing the space required for the passage of the flange 15, and of the behavior of objects related to the properties and shape of the lining 13 of the gap 12 according to the invention.

1) When Solid Objects or Debris are Present in the Gap

FIGS. 5 to 8 illustrate the clearing function and the self-cleaning effect of the lining 13 of the gap 12 according to the invention, in the case of a solid object 36 or various kinds of solid debris that can obstruct the gap 12 as illustrated in perspective in FIG. 5.

The figure shows a cross-section at the level of a solid object 36 in the form of a calibrated test cylinder, just before one of the guide rollers makes contact with it.

During the passage of the inclined guide rollers 23 and 24, the solid object 36 is forced down against the lining material 14 of the gap 12 which, because of its compressibility, sinks down under the pressure of the roller transmitted by the object, as shown.

Thus, the object or debris is pushed out of the way by compressing the flexible material 14 of the lining 13 of the gap 12, whether more or less temporarily or permanently, and this sufficiently to remove opposition to the passage of the roller or at least not deflect the roller vertically to the point of derailment. Thus, the roller is neither damaged nor deflected from its normal path.

Figure 8:
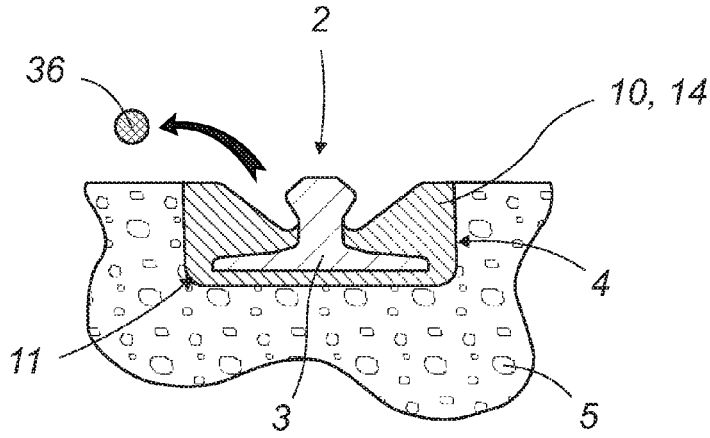

Furthermore, as shown in FIG. 8, after the passage of one of the guide rollers, for example 23, the solid object 36 is often automatically expelled or ejected from the gap 12 by the elastic effect due to the additional characteristics of flexibility and elasticity of the material from which the lining 13 of the gap 12 is made.

2) When Ice or Suchlike is Present in the Gap

Figure 9:
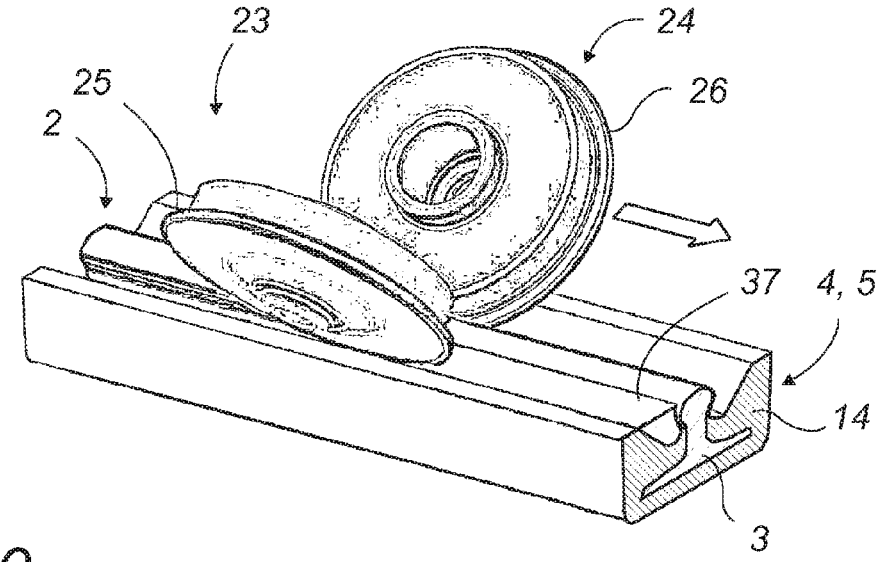
FIGS. 9 to 11: Perspective views illustrating the function of freeing the passage carried out by the gap lining according to the invention, in the case when the gap is obstructed by snow or ice.
Figure 10:
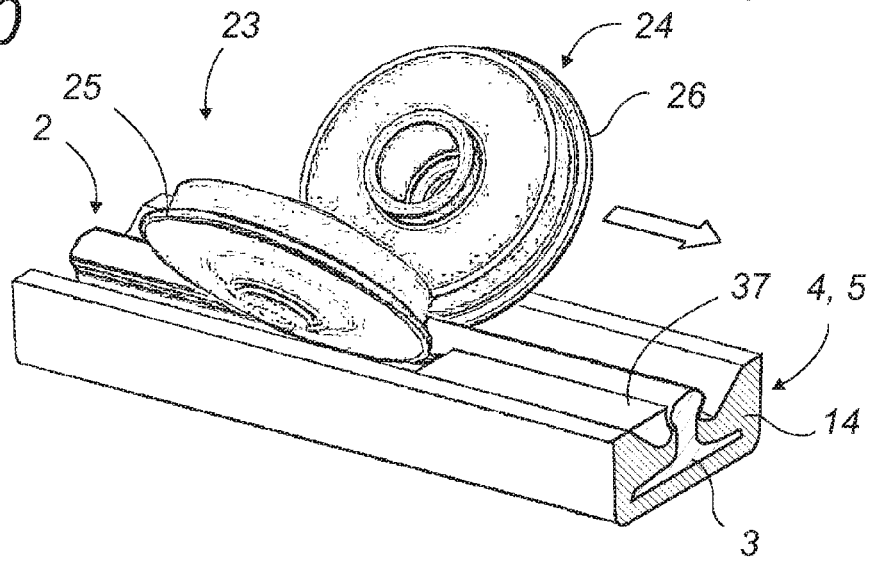
Figure 11:
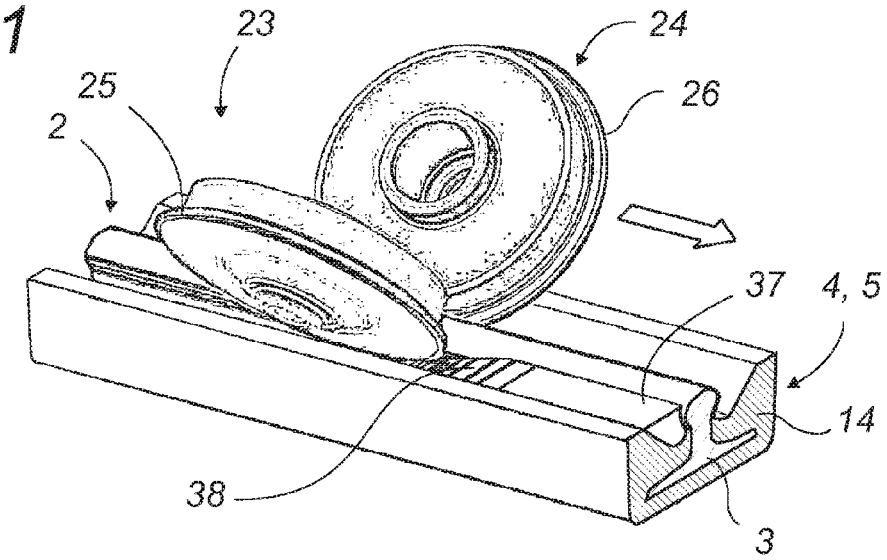

FIGS. 9 to 11 illustrate the effect and the self-cleaning and clearing behavior of the gap lining according to the invention when a gap is obstructed by snow or ice.

In below-zero temperatures water retained in the gap can freeze and fill up the gap 12, as shown in FIG. 9.

It should be noted, however, that this ice can only form when the operation of the transport network using the rail is interrupted, for example during the night. In effect, the repeated passage of vehicles guided by the rail has the effect of keeping the gaps clear.

During the passage of the inclined guide rollers 23 and 24, their flanges 25 and 26 as they move forward exert a vertical force directed downward. Under this force, either the ice moves out of the way by sinking into the flexible material 14 of the lining 13 of the gap 12, or it sinks and breaks up due to the bend and shear stresses produced in the strip or block 37 of ice.

Since the block of ice 37 is often fragile in relation to the stresses, it fractures locally. This effect is repeated as the rollers move forward, at least whichever of the two inclined rollers is above the ice crushing the latter continuously (FIG. 11) and therefore, as the ice sinks into the material, the rollers can pass without losing contact with the rolling track or, worse, becoming derailed. The rollers are neither damaged nor deflected from their normal path.

The crushed ice 38 is then cleared by the passage of the guide rollers, in accordance with the same self-cleaning process as before.

In general, the object or matter is temporarily pressed down onto or sunk into the flexible material 14 of the lining 13 of the gap 12, and thus does not obstruct the movement of the guide roller. So the latter is neither damaged, nor deflected from its normal course.

In addition, once the rollers have passed, the debris or small solid object(s) in contact with the flange(s) is/are generally expelled or ejected out of the gap 12 by the elastic force that results from the flexibility of the material 14 of the lining 13 of the gap 12, this action characterizing the self-cleaning nature of the lining 13 of the gap 12 for guide-rails according to the invention.

It can also be supposed that the object 36 disappears into the depth of the material 14 of the lining 13 during the passage of the flange 15 that exerts a pressure on it as it compresses the gap lining material. Then, either the said object returns to its previous position once the rollers have passed, or it is sufficiently incrusted in the flexible material so as not to interfere with the rollers during their passage and the passage of subsequent rollers. In all such cases roller passage is made possible.

Other embodiments can be imagined by those with knowledge of the field without going outside the general principle of the invention.

The material 14 of the lining 13 of the gap 12 can enclose and even hold rails of any type and shape, and may be suitable for any type of guiding and rolling by flanged roller(s).

It must also be said that the lining material 14 is generally an added material inserted in order to fill each gap 12 at least partially, but that it can just as well be the filler material 10. In that case the material both fills the recess 4 and grips the rail.

The invention claimed is:

1. A self-cleaning assembly for one of a ground-level guide-rail (2) or rolling rail (1) carrying one of rollers or wheels with flanges (15) of a terrestrial vehicle, the rail being fitted into a recess (4) formed in a solid base (5), and being mounted and held in the recess (4) one of flush with the ground or only slightly protruding above ground level and having gaps (12) on at least one side of the rail that corresponds to the passage of the flanges, wherein a lining material (14) is arranged in the gaps (12) outside a dynamic engagement area of the flanges and at least partially lines the gaps, at least partially filling the gaps, the lining material (14) having compressibility properties and being arranged so that under all normal conditions of use or environmental conditions, the lining material (14) maintains the filling of the gaps outside the dynamic engagement area of the flanges (15) of the rollers or wheels moving along the rail; and a lining (13) formed of the lining material (14) opens in a V-shape toward a top and grips the rail (2) at least in a middle area, delimiting on either side of the rail (2), in each case, an area (29, 30) that slopes down toward the rail followed by a longitudinal groove (31, 32).

2. The assembly according to claim 1, wherein the rail is fixed in the recess (4) with a filler material (10) above which the lining material (14) is arranged to fill the gaps at least partially.

3. The assembly according to claim 2, wherein only a foot (3) of the rail is fixed in the recess (4) with the filler material (10).

4. The assembly according to claim 2, wherein the rail rests on the filler material (10).

5. The assembly according to claim 2, wherein the filler material (10) is the same as the lining material (14).

6. The assembly according to claim 2, wherein the rail is a guide-rail (2) and the filler material (10) grips the rail.

7. The assembly according to claim 1, wherein an obstacle (36, 37) to the passage of the flanges is moved out of the way by sinking into or with the lining material (14).

8. The assembly according to claim 1, wherein the lining material (14) is electrically insulating.

9. The assembly according to claim 1, wherein the lining material (14) has a low thermal expansion.

10. The assembly according to claim 1, wherein the lining material (14) is impermeable.

11. The assembly according to claim 1, wherein the lining material (14) does not retain water.

12. The assembly according to claim 1, wherein the lining material (14) is elastic.

13. The assembly according to claim 1, wherein the lining material (14) is at least one of a polymer, an elastomer, a plastomer, a cellular plastic material, a closed-cell foam, a polymer resin, or a composite material type.

14. The assembly according to claim 13, wherein the lining material (14) is a polyurethane foam.

15. The assembly according to claim 1, wherein the lining material (14)contains one of a mineral or an organic filler.

16. The assembly according to claim 1, wherein an upper surface of the lining (13) formed by the lining material (14) is substantially horizontal.

17. The assembly according to claim 1, wherein the lining material (14) is cast into the gap (12).

18. The assembly according to claim 1, wherein the lining material (14) is one of extruded or co-extruded.

19. The assembly according to claim 1, wherein guide rollers are part of a guiding assembly with at least one inclined roller (23, 24).

20. The assembly according to claim 19, wherein the guide assembly comprises two rollers (23, 24) inclined in a V-shape with a point directed downward.

21. The assembly according to claim 1, wherein the rail has a groove (9).

22. The assembly according to claim 1, wherein one of the roller (33) or the wheel (16) has two flanges (34, 35) and the rail is one of a rolling rail (1) or a guide-rail (2) designed to receive the roller or the wheel with the two flanges (34, 35).

23. A self-cleaning assembly for one of a ground-level guide-rail (2) or rolling rail (1) carrying one of rollers or wheels with flanges (15) of a terrestrial vehicle, the rail being fitted into a recess (4) formed in a solid base (5), and being mounted and held in the recess (4) one of flush with the ground or only slightly protruding above ground level and having gaps (12) on at least one side of the rail that corresponds to the passage of the flanges, where a lining material (14) is arranged in the gaps (12) outside a dynamic engagement area of the flanges and at least partially lines the gaps, at least partially filling the gaps, the lining material (14) having compressibility properties and being arranged so that under all normal conditions of use or environmental conditions, the lining material (14) maintains the filling of the gaps outside the dynamic engagement area of the flanges (15) of the rollers or wheels moving along the rail;

the rail has a groove (9); and the lining material (14) is located in the groove (9).

24. The assembly according to claim 23, wherein an obstacle (36, 37) to the passage of the flanges is moved out of the way by sinking into or with the lining material (14).

25. The assembly according to claim 23, wherein material (14) is one of electrically insulating, a low thermal expansion material, an impermeable material, a material which does not retain water and an elastic material.

26. The assembly according to claim 23, wherein the lining material (14) is at least one of a polymer, an elastomer, a plastomer, a cellular plastic material, a closed-cell foam, a polymer resin, or a composite material type.

27. The assembly according to claim 23, wherein the lining material (14) contains one of a mineral or an organic filler.

28. The assembly according to claim 23, wherein an upper surface of the lining (13) formed by the lining material (14) is substantially horizontal.

29. The assembly according to claim 23, wherein the lining material (14) is one of extruded or co-extruded.

* * * * *